United States Patent [19]

Colin

[11] 4,000,714

[45] Jan. 4, 1977

[54] SYSTEM FOR INTERCONNECTING A BARGE AND A PUSHER TUG

[75] Inventor: Jean Paul Colin, Nantes, France

[73] Assignee: Ateliers et Chantiers de Bretagne - A.C.B., France

[22] Filed: May 7, 1975

[21] Appl. No.: 575,234

Related U.S. Application Data

[63] Continuation of Ser. No. 385,577, Aug. 3, 1973, abandoned.

[30] Foreign Application Priority Data

Aug. 9, 1972 France ..... 72.28708

[52] U.S. Cl. ..... 114/248; 114/249

[51] Int. Cl.[2] ..... B63B 21/56

[58] Field of Search ..... 114/235 R, 235 A, 77 R, 114/75 R

[56] References Cited

UNITED STATES PATENTS

| | | | |
|---|---|---|---|
| 2,856,867 | 10/1958 | Dasey | 114/75 |
| 3,362,372 | 1/1968 | Peterson | 114/235 R |
| 3,492,964 | 2/1970 | Garcia | 114/235 R |
| 3,820,258 | 6/1974 | Fahrner | 114/235 R |

*Primary Examiner*—Trygve M. Blix
*Assistant Examiner*—Gregory W. O'Connor
*Attorney, Agent, or Firm*—Stevens, Davis, Miller & Mosher

[57] ABSTRACT

A system for interconnecting a barge and a pusher tug in which the stern of the barge is provided with a groove having a cross-section complementary to that of the bow of a pusher tug which it is to receive in mating engagement. The mated vessels define a clearance zone and are held together by a connecting rod. The two vessels are provided in the said clearance zone with support plates and inflatable compression devices such as inflatable cushions.

14 Claims, 2 Drawing Figures

SYSTEM FOR INTERCONNECTING A BARGE AND A PUSHER TUG

This is a continuation of application Ser. No. 385,577 filed Aug. 3, 1973, now abandoned.

The invention relates to a system for interconnecting barges and pusher tugs.

Such systems are known in which the two vessels comprise complementary inclined surfaces which enable the vessels to be jammed together using a jack. Such systems have the disadvantage that they require the use of very powerful jacks, all the more so since the force which must be exerted on the vessels to separate them from one another is even greater than that required to jam them together. Other disadvantages arise in that it is difficult to use the same pusher tug for different barges, and the position of the pusher tug in operation with the barge is not absolutely defined and may vary during the life of the systems assembly.

It is the object of this invention to obviate the disadvantages set out above.

Accordingly, we provide a system for interconnecting a barge and a pusher tug, characterized in that the stern part of the barge is formed with a longitudinal groove or recess of substantially inverted T-section to which the bows of the pusher tug can adapt itself with clearance when the tug and barge are brought together, the barge and tug being secured to each other via thrust transmitting member and by the hull of the pusher tug in the groove in the said barge, using planes of variable level. The clearance referred to is typically several decimeters.

Preferably axial forces originating from thrust of the propeller and effects due to ocean swell are transmitted by a connecting rod or some other rigid passive device without resilience which is not subjected to any component of the forces substantially at right-angles to the longitudinal axis of the combined barge and pusher tug.

The hull of the pusher tug is preferably secured to the barge by means of inflatable cushions interposed between the barge and the pusher tug and advantageously, but not necessarily, borne and fed by the pusher tug. A number of series of cushions can be provided acting respectively in substantially horizontal or vertical directions on the edges of the groove in the barge, one of the edges and bottom of the barge having platings against which the pusher tug bears. The hull of the pusher tug can also be secured by using hydraulic jacks with a suitable relatively short stroke.

Figure 1:
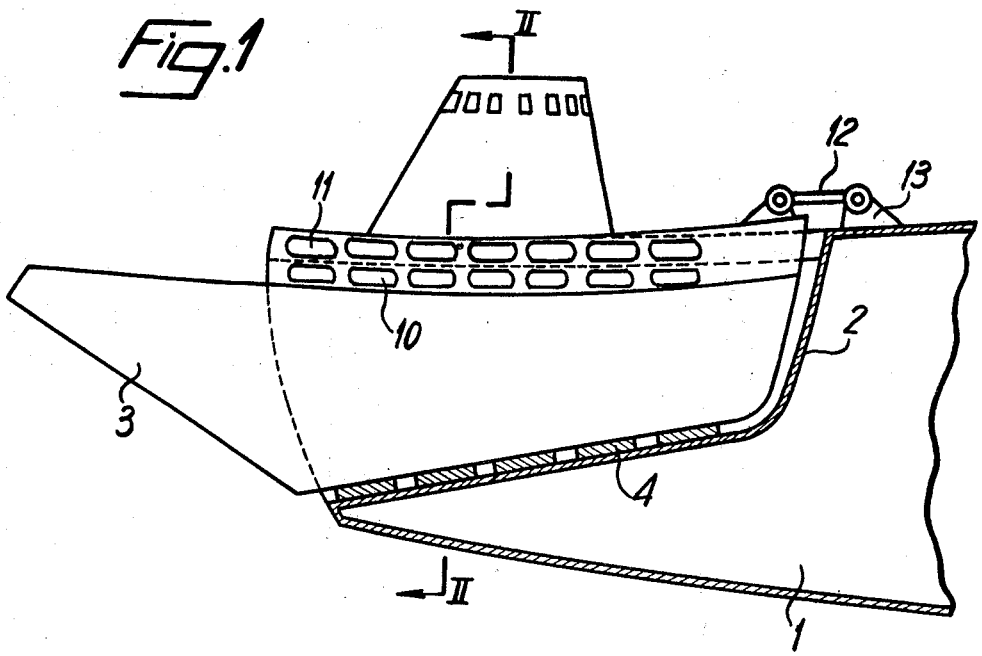
Figure 2:
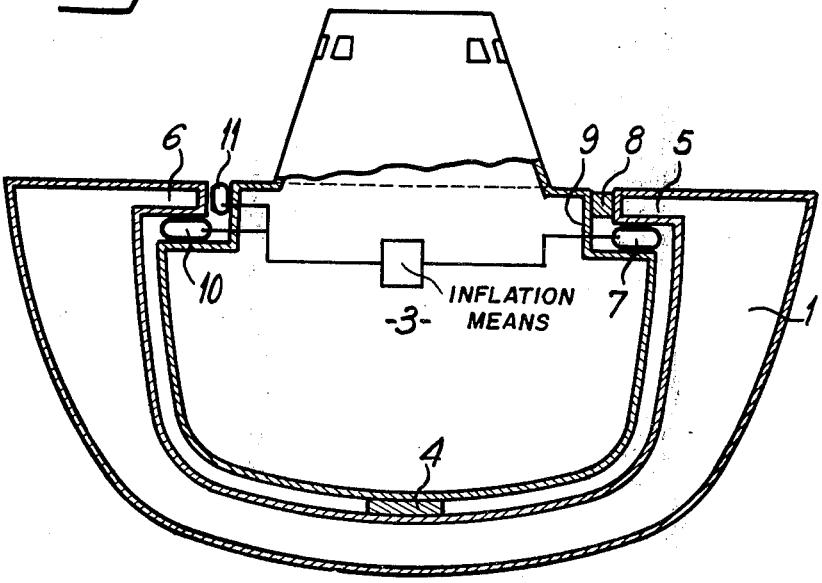

The invention will be more clearly understood from the following description of one example with reference to the figures of the accompanying drawing, wherein:

FIG. 1 is a diagrammatic longitudinal section of an assembly formed by an interconnected barge and pusher tug, and FIG. 2 is a sectional end elevation, taken on the section station II—II of FIG. 1.

Referring now specifically to the figures, the stern of a barge 1 is formed with a longitudinal groove 2 of substantially inverted T-shaped section to which the bow of a pusher tug 3 can adapt itself with a clearance of approximately several decimeters.

The bottom of the longitudinal groove 2 is directed at an angle upwards and forwards and bears in its center plating 4, formed, for instance, by metal plates, against which the bottom of the pusher tug keel inclined at the same angle bears.

The upper part of the groove 2 forms two longitudinal edges 5, 6 against which the tops of the sides of the hull of the pusher tug bear.

The longitudinal edge 5 has undersurfaces beneath which inflatable cushions 7, of rubber or similar elastomer, bear which are borne by the top of the starboard side of the pusher tug and lateral platings 8 against which matching surfaces 9 with which the pusher tug is formed bear.

The longitudinal edge 6 is adapted to cooperate with two series of inflatable cushions 10, 11 with which the pusher tug is equipped and which, like the cushions 7, are made of rubber or some similar elastomer.

The cushions 10 are so attached to the top of the port side of the deck of the pusher tug as to engage beneath the longitudinal edge 6 of the barge 1 when the bow of the pusher tug 3 enters the groove 2 therein, while the cushions 11 are so disposed along the correspondng vertical wall of the superstructure of the pusher tug that they face the inside end of the longitudinal edge 6.

To keep the barge 1 and the pusher tug 3 interconnected and assembled together, a thrust-transmitting member in the form of a connecting rod 12 borne by the pusher tug 1 is connected to a lug 13 disposed on the barge 1 forward of the longitudinal groove 2; then the cushions 7, 10, 11 are simultaneously inflated, for instance, with pressurized oil, and force the bow of the pusher tug against the various bearing platings.

The connecting rod 12 transmits the thrust forces but is not subjected to any component of the forces substantially at right-angles to the longitudinal axis of the combined barge and pusher tug. The cushions 7, 10, 11 operate only in the direction at right-angles to their major surface and therefore in a very rational manner to keep the tug and barge interconnected to one another as they move.

The invention can be applied to all kinds of barges and pusher tugs and is more particularly suitable for sea-going or river traffic barges and pusher tugs.

Clearly, modifications can be made to the embodiments disclosed hereinbefore, inter alia, by the substitution of equivalent technical means, without exceeding the scope of the invention.

I claim:

1. In a system for interconnecting a barge and a pusher tug, having the stern of the barge complementary with the bow of the pusher tug, an improvement for interconnecting the said barge and said pusher tug, said improvement comprising a longitudinal groove in the stern part of the barge, said groove having a section substantially of inverted T form to which the said bow of the said pusher tug conforms with clearance when the tug and barge are brought together, a rigid thrust transmitting passive member attached at one end to said pusher tug and at the other end to the stern of said barge so as to transmit longitudinal forces and not forces at right-angles to the longitudinal axis of the combined barge and pusher tug, inflatable means fixed in position within the clearance between said tug and said barge, and means for inflating said inflatable means after said barge and tug have been interconnected by said thrust transmitting member.

2. A system as defined in claim 1 in which said thrust transmitting member is a connecting rod articulated to said pusher tug and said barge, said rod being not subjected to any component of forces substantially at right-angles to the longitudinal axis of the interconnected barge and pusher tug.

3. A system as defined in claim 1 in which the bow of the pusher tug is adapted to be secured to the stern of the barge by inflatable means interposed in said clearance between said barge and said bow of said pusher tug.

4. A system as defined in claim 3 in which the inflatable means are inflatable cushions.

5. A system as defined in claim 1 in which the inflatable means are cushions distributed in three series, said series acting in substantially horizontal directions on the edge of the said longitudinal groove in said stern part of said barge.

6. A system as defined in claim 1 in which the inflatable means are cushions distributed in three series, said series acting in substantially vertical directions on the edge of the said longitudinal groove in said stern part of said barge.

7. In a system for interconnecting a barge and a pusher tug, having the stern of the barge complementary with the bow of the pusher tug, an improvement for interconnecting the said barge and said pusher tug, said improvement comprising a longitudinal groove in the stern part of the barge, said groove having a section substantially of inverted T form to which the said bow of the said pusher tug conforms with clearance when the tug and the barge are brought together, a rigid thrust transmitting passive member attached at one end to said pusher tug and at the other end to the stern of said barge so as to transmit longitudinal forces and not forces at right-angles to the longitudinal axis of the combined barge and pusher tug, inflatable means installed on said pusher tug fixed in position within the clearance between said tug and said barge, and means for inflating said inflatable means after said barge and tug have been interconnected by said thrust transmitting member.

8. In a system for interconnecting a barge and a pusher tug, having the stern of the barge complementary with the bow of the pusher tug, an improvement for interconnecting the said barge and said pusher tug, said improvement comprising a longitudinal groove in the stern of the barge, said groove having a section substantially of inverted T form to which the said bow of the said pusher tug conforms with clearance when the tug and the barge are brought together, a rigid thrust transmitting passive member attached at one end to said pusher tug and at the other end to the stern of said barge so as to transmit longitudinal forces and not forces at right-angles to the longitudinal axis of the combined barge and pusher tug, inflatable means installed on said barge fixed in position within the clearance between said tug and said barge, and means for inflating said inflatable means after said barge and tug have been interconnected by said thrust transmitting member.

9. In a system for interconnecting a barge and a pusher tug, having the stern of the barge complementary with the bow of the pusher tug, an improvement for interconnecting the said barge and said pusher tug, said improvement comprising a longitudinal groove in the stern part of the barge, said groove having a section substantially of inverted T form to which the said bow of the said pusher tug conforms with clearance when the tug and barge are brought together, a rigid thrust transmitting passive member attached at one end to said pusher tug and at the other end to the stern of said barge so as to transmit longitudinal forces and not forces at right-angles to the longitudinal axis of the combined barge and pusher tug, inflatable means fixed in position within the clearance between said tug and said barge, and a source of energy for inflating said inflatable means after said barge and tug have been interconnected by said thrust transmitting member, said source of energy being installed on said pusher tug.

10. In a system for interconnecting a barge and a pusher tug, having the stern of the barge complementary with the bow of the pusher tug, an improvement for interconnecting the said barge and said pusher tug, said improvement comprising a longitudinal groove having a section substantially of inverted T form to which the said bow of the said pusher tug conforms with clearance when the tug and barge are brought together, a rigid thrust transmitting passive member attached at one end to said pusher tug and at the other end to the stern of said barge so as to transmit longitudinal forces and not forces at right-angles to the longitudinal axis of the combined barge and pusher tug, inflatable means fixed in position within the clearance between said tug and said barge, and a source of energy for inflating said inflatable means after said barge and tug have been interconnected by said thrust transmitting member, said source of energy being installed on said barge.

11. In a system for interconnecting a barge and a pusher tug, having the stern of the barge complementary with the bow of the pusher tug, an improvement for interconnecting the said barge and said pusher tug, said improvement comprising a longitudinal groove in the stern part of the barge, said groove having a section substantially of inverted T form to which the bow of the said pusher tug conforms with clearance when the tug and barge are brought together, a rigid thrust transmitting passive member attached at one end to said pusher tug and at the other end to the stern of said barge so as to transmit longitudinal forces and not forces at right-angles to the longitudinal axis of the combined barge and pusher tug, and a short-stroke hydraulic jack positioned within said clearance for positioning said barge and tug.

12. In a system for interconnecting a barge and a pusher tug, having the stern of the barge complementary with the bow of the pusher tug, an improvement for interconnecting the said barge and said pusher tug, said improvement comprising a longitudinal groove in the stern part of the barge, said groove having a section substantially of inverted T form to which the said bow of the said pusher tug conforms with clearance when the tug and barge are brought together, said groove containing platings against which the said pusher tug bears, a rigid thrust transmitting passive member attached at one end to said pusher tug and at the other end to the stern of said barge so as to transmit longitudinal forces and not forces at right-angles to the longitudinal axis of the combined barge and pusher tug, inflatable means fixed in position within the clearance between said tug and said barge, and means for inflating said inflatable means after said barge and tug have been interconnected by said thrust transmitting member.

13. A system as defined in claim 12 in which said platings are disposed on one edge of the said longitudinal groove and also on the bottom of said longitudinal groove.

14. The method of interconnecting a barge and a pusher tug, said barge having a recess in the stern thereof to which the bow of said pusher tug conforms with clearance when the tug and barge are brought together, said method comprising the steps of positioning said pusher tug within the recess in the stern of said barge with clearance between said tug and barge, attaching one end of a rigid thrust transmitting passive member to said tug and the other end of said member to the stern of said barge, and inflating inflatable means fixed in position within the clearance between said tug and said barge, said rigid thrust transmitting passive member transmitting forces directed along the longitudinal axis of the combined barge and pusher tug but not being subjected to any component of the forces substantially at right-angles to said longitudinal axis, and said inflatable means when inflated exerting forces at right-angles to the major surfaces of said pusher tug and barge, said thrust transmitting member and inflated inflatable means maintaining said pusher tug and barge interconnected to one another as they move.

* * * * *